US007171793B2

(12) United States Patent
Gordin et al.

(10) Patent No.: US 7,171,793 B2
(45) Date of Patent: Feb. 6, 2007

(54) MEANS AND METHOD FOR RIGIDLY ELEVATING A STRUCTURE

(75) Inventors: Myron K. Gordin, Oskaloosa, IA (US); Jim L. Drost, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 09/964,301

(22) Filed: Sep. 26, 2001

(65) Prior Publication Data

US 2002/0007613 A1 Jan. 24, 2002

Related U.S. Application Data

(63) Continuation of application No. 08/714,623, filed on Sep. 16, 1996, now abandoned, which is a continuation of application No. 08/407,574, filed on Mar. 20, 1995, now abandoned, which is a continuation of application No. 08/103,333, filed on Aug. 6, 1993, now Pat. No. 5,398,478, which is a continuation of application No. 07/730,355, filed on Jul. 15, 1991, now abandoned, which is a continuation of application No. 07/472,822, filed on Jan. 31, 1990, now abandoned.

(51) Int. Cl.
*E04C 3/34* (2006.01)
*E04H 12/00* (2006.01)

(52) U.S. Cl. ..... 52/726.4; 52/169.13; 52/297; 52/736.2; 52/742.13; 405/232; 362/431; 174/45 R

(58) Field of Classification Search ..... 52/126.1, 52/169.9, 169.13, 297, 726.4, 726.1, 736.1, 52/736.2, 720.1, 720.2, 742.1, 745.17; 403/334; 362/431, 249; 174/45 R; 405/232, 251
See application file for complete search history.

(56) References Cited

U.S. PATENT DOCUMENTS 295,905 A * 4/1884 Brott ..... 52/723.1

(Continued)

FOREIGN PATENT DOCUMENTS

DE 426074 3/1935

(Continued)

OTHER PUBLICATIONS

"Sportsliner II-50" by CentreCon, Inc. Dec. 1986.*

(Continued)

*Primary Examiner*—Winnie Yip
(74) *Attorney, Agent, or Firm*—McKee, Voorhees & Sease, P.L.C.

(57) ABSTRACT

A means and method for rigidly elevating a structure includes a base member securable in the ground and which has a portion extending above the ground. A pole section, having a bore inside a lower end, and an upper end, can be stacked upon the base means upwardly by slip fitting the pole section onto the base end and securing it in place. A flexible, easily transportable and durable system is thereby created for elevating structures.

38 Claims, 7 Drawing Sheets

U.S. PATENT DOCUMENTS

| | | | | | |
|---|---|---|---|---|---|
| 411,204 | A | | 9/1889 | Short | |
| 453,286 | A | * | 6/1891 | Lieb | 52/169.13 |
| 595,600 | A | * | 12/1897 | Buck | 256/47 |
| 689,387 | A | | 12/1901 | Crossland | |
| 732,223 | A | | 6/1903 | Rhodes | |
| 839,272 | A | | 12/1906 | Crow | |
| 976,879 | A | | 11/1910 | Hughs | |
| 1,083,120 | A | | 12/1913 | May | |
| 1,244,652 | A | * | 10/1917 | Southgate | 52/184 |
| 1,329,026 | A | | 1/1920 | Snyder | |
| 1,542,575 | A | | 6/1925 | Perry | |
| 1,567,301 | A | | 12/1925 | Ross | |
| 1,679,297 | A | | 7/1928 | Ehrler | |
| 2,036,771 | A | * | 4/1936 | Pfistershammer | 52/298 |
| 2,040,010 | A | * | 5/1936 | McMahon | 52/127.2 |
| 2,066,419 | A | * | 1/1937 | Pfistershammer | 52/736.2 |
| 2,510,717 | A | | 6/1950 | Roos | |
| 2,792,947 | A | * | 5/1957 | Weedman | 414/23 |
| 2,985,261 | A | | 5/1961 | Kubesh | |
| 2,998,106 | A | | 6/1961 | Aust | |
| 3,034,209 | A | * | 5/1962 | Bianca et al. | 29/432 |
| 3,270,480 | A | * | 9/1966 | Beecker | 52/726.4 |
| 3,355,847 | A | | 12/1967 | Pratt | |
| 3,364,635 | A | | 1/1968 | Guggemos | |
| 3,403,520 | A | * | 10/1968 | Goodman | 405/303 |
| 3,429,129 | A | | 2/1969 | Johansson et al. | |
| 3,638,433 | A | * | 2/1972 | Sherard | 405/50 |
| 3,646,401 | A | | 2/1972 | Freegard | |
| 3,713,262 | A | * | 1/1973 | Jatcko | 52/98 |
| 3,858,866 | A | | 1/1975 | Armstrong | |
| 3,865,498 | A | * | 2/1975 | Okuto et al. | 403/292 |
| 3,911,548 | A | * | 10/1975 | Perry | 29/402.12 |
| 3,936,206 | A | * | 2/1976 | Meisberger | 403/334 |
| 3,958,381 | A | | 5/1976 | Meyer | |
| 3,991,532 | A | | 11/1976 | Buxbom | |
| 4,033,080 | A | * | 7/1977 | Fukushima | 52/223.4 |
| 4,092,079 | A | | 5/1978 | Swanson | |
| 4,181,929 | A | | 1/1980 | Barber et al. | |
| 4,190,881 | A | | 2/1980 | Drost et al. | |
| 4,198,022 | A | | 4/1980 | Pletcher et al. | |
| 4,220,981 | A | | 9/1980 | Koether | |
| 4,237,530 | A | | 12/1980 | Murray | |
| 4,246,732 | A | * | 1/1981 | Frehner | 52/726.4 |
| 4,272,929 | A | | 6/1981 | Hanson | |
| 4,327,534 | A | | 5/1982 | Mastalski et al. | |
| 4,374,407 | A | | 2/1983 | Drost et al. | |
| 4,450,507 | A | | 5/1984 | Gordin | |
| 4,492,496 | A | * | 1/1985 | Arnold | 405/303 |
| 4,617,768 | A | | 10/1986 | Gebelius | |
| 4,673,157 | A | | 6/1987 | Wells | |
| 4,719,540 | A | | 1/1988 | San George et al. | |
| 4,779,389 | A | * | 10/1988 | Landers | 52/169.13 |
| 4,796,001 | A | | 1/1989 | Gostyla | |
| 4,878,160 | A | * | 10/1989 | Reneau et al. | 362/269 |
| 4,894,759 | A | | 1/1990 | Siems | |
| 4,903,442 | A | | 2/1990 | Trommen | |
| 4,930,270 | A | | 6/1990 | Bevacqua | |
| 5,398,478 | A | | 3/1995 | Gordin et al. | |
| 5,600,537 | A | | 2/1997 | Gordin et al. | |
| 5,820,255 | A | | 10/1998 | Carrington et al. | |
| 6,340,790 | B1 | | 1/2002 | Gordin et al. | |
| 6,398,392 | B2 | | 6/2002 | Gordin et al. | |

FOREIGN PATENT DOCUMENTS

| | | | |
|---|---|---|---|
| DE | 705891 | | 3/1954 |
| DE | 2 255 713 | | 11/1972 |
| DE | 2255713 | * | 11/1972 |
| DE | 27 08 664 A1 | | 9/1977 |
| DE | 3220531 | * | 2/1984 |
| DE | 3 440 531 C1 | | 3/1986 |
| EP | 0 440 531 B1 | | 8/1991 |
| FR | 876891 | * | 11/1941 |
| FR | 1162522 | * | 4/1958 |
| FR | 1.162.522 | | 9/1958 |
| FR | 1 605 015 | | 10/1972 |
| FR | 2536780 | * | 11/1982 |
| FR | 2 536 780 A1 | | 6/1984 |
| FR | 2 616 471 | | 12/1988 |
| GB | 717699 | | 11/1951 |
| GB | 784749 | | 10/1957 |
| GB | 862350 | | 3/1961 |
| GB | 2 205 392 A | | 6/1988 |
| IO | 717699 | * | 11/1951 |
| IO | 705891 | * | 3/1954 |
| IO | 862350 | * | 3/1961 |
| JP | 53-16479 | | 2/1978 |
| MX | 175863 | | 1/1991 |
| SE | 8202141-9 | | 11/1985 |
| SU | 135629 | | 3/1961 |

OTHER PUBLICATIONS

"FL Series floodlighting" by CentreCon, Inc. Sep. 1982, pp. FI 20-21.*

Centrecon Sportsliner II-50 (Brochure) (Dec. 1986), 4 pages.

Centrecon FL Series Floodlighting (Brochure) (Sep. 1982), 2 pages.

Abacus-raising and lowering lighting columns 3m to 35m height; Printed in England; 1985, Abacus Municipal, Ltd. (Brochure), 13 pages. Union Metal Corporation, 1022 9th Street S.W., Canton, OH 44711;.

* cited by examiner

MEANS AND METHOD FOR RIGIDLY ELEVATING A STRUCTURE

CROSS REFERENCE TO RELATED APPLICATIONS

This application is a continuation of U.S. patent application Ser. No. 08/714,623 filed on Sep. 16, 1996, now abandoned, which is a continuation of U.S. patent application Ser. No. 08/407,574 filed Mar. 20, 1995, now abandoned; which is a continuation of U.S. patent application Ser. No. 08/103,333 filed Aug. 6, 1993, now U.S. Pat. No. 5,398,478 issued Mar. 21, 1995; which is a continuation of Ser. No. 07/730,355 filed Jul. 15, 1991, now abandoned, which is a continuation of U.S. patent application Ser. No. 07/472,822 filed Jan. 31, 1990, now abandoned, the contents of which are hereby incorporated by reference in their entirety.

BACKGROUND OF THE INVENTION

Field of the Invention

The present invention relates to a means and methods for elevating structures, and in particular, to poles anchored in the ground for vertically elevating any type of member or members to an extended distance.

A number of structures or things must be suspended from the ground. Examples are light fixtures, sirens, antennas, wires, and the like. Many times these structures need to be rigidly supported. Of course, a conventional means to accomplish this is to utilize an elongated pole.

Commonly known examples of poles of this type are telephone poles, electrical wire poles, light poles, sign poles, and utility poles. Most of these types of poles are anchored in the ground and extend vertically upward to many times tens of feet in height.

The widespread utilization of these types of poles is indicative of the preference to utilize elongated structures or poles to elevate objects in the air. For whatever reasons, whether it be economical or practical, the demand for the poles is very high for a number of different uses.

Poles of this nature can be made of a number of materials and can be erected and installed in a number of ways. While each of the commonly used poles achieves the end result of elevating objects in the air, the different types commonly used have both their advantages and disadvantages.

Wood poles represent the longest used and still today the many times preferred type of pole. They are relatively inexpensive, have a good height to diameter strength ratio, and can be rather easily adapted for a number of uses.

Problems and disadvantages of wood poles, however, are at least:

a. Difficult to find straight wood poles, especially for taller heights;
b. Natural processes decay or at least weaken wood;
c. Wood is fairly heavy;
d. Pole comes in single long length which can be difficult to transport;
e. Environmental problems associated with using trees could effect availability;
f. Appearance;
g. Uncertainty of strength; and
h. Bottom end is buried in the ground and therefore even more susceptible to decay and deterioration.

Wood, therefore, may represent a cheaper, more available source for at least shorter poles, but is not the preferred type of pole because of, in significant part, some of the above mentioned problems.

An alternative pole that has more recently been utilized is one made substantially of concrete. For even significantly tall poles, concrete has great strength in compression and with a steel cable infra structure offers strength in tension. With advances in the nature of concrete, such poles offer a relatively economical and very strong alternative to wood.

Disadvantages of concrete are at least the following, however:

a. Very heavy, even with a hollow core (may not be able to make very long);
b. Require a big crane or other power means to lift them;
c. The weight tends to cause them to shift when positioned in the ground;
d. It is somewhat difficult to form holes or otherwise attach structures to such poles; and
e. Such poles present shipping problems due to weight, length, and width.

Again, while concrete poles do provide some advantages, their disadvantages prevent them from being the preferred used type of pole.

These types of above-mentioned deficiencies have resulted in the pole of preference being comprised of a steel pole which is anchored in the ground usually to poured concrete fill. Such a combination allows the use of high strength yet lightweight hollow tube steel for the above ground portion, while utilizing lower cost and high weight concrete as the anchor in the ground. This also aids in installation as the concrete bases can be poured and then the lightweight steel poles mounted thereon.

These advantages do not come without a price however. The disadvantages of this type of pole are at least the following:

a. Most expensive;
b. Concrete and re-bar (if used) must be custom designed;
c. Heavy, thick base plate must be welded to the light-weight steel tube;
d. Galvanizing, which is the preferred protective coating, is sensitive to the temperature differences between the thick base and thin tube;
e. Concrete foundations must be accurately constructed on the site according to the custom design;
f. The poles and the concrete fill, and any other hardware many times are required to come from different sources and therefore may not adequately match; and
g. Corrosion problems.

As can be appreciated, the problems with steel and concrete foundation poles are not insignificant. Because the joint between the steel and concrete will have to take much of the stress provided by the long moment arm of the upwardly extending pole, and because of wind load and other factors, it is critical that for each installation the junction between the pole and the foundation be accurately and correctly prepared. This is an intricate matter requiring not only the correct design specifications and construction of the concrete foundation and the steel pole, but also accurate and faithful-adherence to design and installation specifications by field personnel in forming the concrete foundation.

The custom design must include not only the height and weight requirements associated with each particular pole, but also must consider the type and strength of concrete used, the design of the re-bar cage in the concrete, and the design and placement of hardware attaching the steel pole to the concrete.

As is well understood by those with ordinary skill in the art, a custom design for the concrete foundations requires significant expenditure of resources. Additionally, the success of the design is then entirely dependent upon its implementation in the field.

Unfortunately, a significant and real problem exists in contractors carrying out the installations not doing so accurately. Without a reliable match between the design parameters of the concrete foundation and the parameters associated with the steel pole with its actual installation, the entire pole structure is susceptible to damage or failure. Accordingly, substantial expense may be incurred over designing and installing the concrete foundations to allow for field installation tolerances. Additionally, concrete requires up to 28 days to develop full strength needed for strength and to anchor the bolts used to secure the pole.

A second major problem with steel pole and concrete foundation combinations is that of corrosion. While presently the corrosion problems are addressed by attempting to galvanize all metal components, at least the following impediments exist to that being successful.

The best environment for corrosion is generally within a few feet above and below the ground line. Most concrete and steel poles such as described above have the concrete bases foundations poured and submerged from ground level down. Therefore, the most corrosion-susceptible area of the metal, at or near the joint with the concrete, is in that area where corrosion is the most likely. Moisture in the form of standing water and condensation is most concentrated in this area. Additionally, this is also an area where the concentration of oxygen is high, which is one of the components of corrosion and rust.

Secondly, as previously mentioned, the joint between the steel pole and the concrete foundation often represents the highest stress area for the combination. It is known in the art that corrosion increases with stress.

Third, the conventional way of securing the joint is to utilize long bolts through a mounting plate of the steel pole into the concrete. These bolts also take a majority of the stress and are therefore very susceptible to corrosion.

Fourth, galvanizing simply cannot be very reliable for the following reasons. Stress is detrimental to galvanization. An annular base plate for the metal pole must be welded to the tubular elongated portion of the pole. For galvanization to be reliable, the surface must be extremely clean. Debris or dirt in general, and in particular flux, which is hard to remove around welded joints, will not take galvanization. Sometimes direct-bury steel poles are utilized. Corrosion problems as well as installation problems similar to described above exist.

Additionally, galvanization is accomplished by heating the metal. For reliable galvanization, the metal must be heated uniformly. However, the baseplate must be made of a much thicker metal than the thin tubular pole on a practical commercial scale. It is almost difficult during a reasonable production time to have a thick-in-cross-section metal portion connected to a thin-in-cross-section metal portion have the same temperature when exposed to heat.

Additionally, the chemical nature of the steel or metal must be known to obtain the correct galvanization result. Heat differences can even crack the weld or otherwise damage the joint or pole. The plate is generally made of a different metal than the pole.

In short, the mounting plate and metal pole must be galvanized inside and out to resist corrosion. For at least the above reasons, it is very difficult to get such a combination correctly galvanized. At a minimum, it is very expensive to do it right. Then, even once galvanized, the high stress in the area is damaging to the galvanization. Another risk is to cracking of the weld because of different thickness of metal.

It can therefore be seen that the conventional types of poles simply have significant and real problems which are detrimental or are disadvantageous. There is a real need in the art for a pole system which does not have these problems.

Additional problems with regard to presently used poles are also significant in the art. One very practical and real problem is involved with the shipping of such poles. For many uses, poles are needed of lengths of thirty, forty, and even up to over 100 feet. While some applications require many poles of similar lengths, and therefore may be sent by rail shipment, where long lengths can probably be accommodated, many applications for such poles require only a relatively small number. To ship such a number by rail is expensive, particularly when many of these applications still require some other type of over-the-highway transportation to the ultimate location.

Generally trucks have a maximum effective carrying length of between 40 and 48 feet, at least, for semi-trailers. However, the effective load carrying length generally is no longer than around 48 feet. Therefore, it is simply not possible to ship poles of much longer length than this via tractor trailer without special and expensive permits.

While attempts have been made to produce concrete poles in segments, this requires significant installation efforts and joints would create risk and problems. Additionally, it must be understood that wood and concrete poles, with their heavy weight, present shipping problems. Even with shipment in tractor trailers, there is a weight limit of approximately 45 thousand pounds, even for the longest semi-trailers. This would limit the number of such poles that could be transported in one truck as some poles, such as concrete, can each weigh several thousand pounds, and even around or over ten-thousand pounds.

Additionally, weight permits are required for increasingly heavy loads. Thus, the closer you come to the maximum weight per trailer and truck, the more costs are incurred in obtaining permits and the like for such heavy loads. This is important because optimally the goal would be to have one tractor trailer carry all the poles and parts required for one installation. Because of limit on truck length and load weight limits, concrete and even wood poles have certain limitations.

Still further, for steel poles which are installed with conventional poured concrete foundations, it may be possible to transport the poles in trucks, but a disadvantage is again the requirement that the concrete foundations be created and installed by a local contractor where, in most cases, quality control is less reliable. In other words, the entire combination (pole and foundation) cannot be manufactured and shipped as one unitary shipment and much reliance on a successful installation is with the installer at the site.

The above rather detailed discussion of conventional poles is set forth to attempt to aid in an understanding of the many factors which are involved in choosing a type of pole, manufacturing it, installing it, and ultimately maintaining it for an extended, economical, and effective useful life. There is no presently satisfactory system which is adaptable to virtually every situation, is flexible in that it can be anchored in all sorts of locations and ground types and all sorts of weather environments, and is useful for all sorts of heights, wind loads, and types of structures to be elevated.

Still further, for purposes of economy, there is a real need for a pole system which can be easily shipped, whether only a few or quite a few; is easy in terms of labor and resources to install; and which can be maintained over a long life span.

Finally, there is a real need for an efficient pole system which allows easy installation and shipment of the entire system together, along with the structure or structures to be elevated and any attendant hardware, such as wiring and the like.

It is therefore a principle object of the present invention to provide a means and method for rigidly elevating a structure which improves over or solves the deficiencies and problems in the art.

Another object of the present invention is to provide a means and method as above described which is generally universal in its application for elevating different structures to different heights for different situations, and with respect to different installations of the base in the ground.

A still further object of the present invention is to provide a means and method as above described which is economical in terms of the manufacture, materials, transportation, installation, labor, and life span.

Another object of the present invention is to provide a means and method as above described which is easy to assemble, install, and maintain.

A still further object of the present invention is to provide a means and method as above described which is durable and strong, both in its individual components and compositely.

Another object of the present invention is to provide a means and method as above described which permits pre-installation design and concurrent shipment of all or most components for each installation.

A further object of the present invention is to provide a means and method as above described which improves corrosion resistance.

Another object of the present invention is to provide a means and method as above described which is an improvement with respect to the problems caused by stress.

These and other objects, features, and advantages of the present invention will become more apparent with reference to the accompanying specification and claims.

SUMMARY OF THE INVENTION

The present invention relates to means and methods for an improved pole system for rigidly elevating an object or structure in the air with a base anchored in the ground. The invention specifically solves or improves over many of the deficiencies in the prior art by utilizing a special concrete base which is anchored in the ground but to which a lightweight, strong steel pole section or sections can be easily yet reliably secured.

The base includes an upper portion which extends above the ground. The pole has a mating interior bore at its lower end which slip fits over the upper section of the base, but does not get nearer than a few feet from the ground. The upper portion of the base and the interior bore of the pole can either both be tapered in a manner that the pole can be slip fitted a predetermined distance onto the tapered part of the base and secured there, or if the parts are not tapered, have a stop member control how far the pole fits over the base.

Optionally, the pole can be comprised of a plurality of steel sections, each added to the top of the preceding section in turn beginning with the steel section attached to the base in a similar manner by slip fitting each section to the other.

The system therefore provides a strong, almost unitary pole structure which can be adapted to virtually any situation or location. The strength of the base can be designed to accommodate various pole heights and various ground conditions by altering the make-up of the concrete of the base and any reinforcing structure, as to the width of the base, and the length of the base and other factors. Also, predefined simple methods of field modifications can be made. In all instances, any metal portions of the pole are kept out of the high corrosion zone near the ground level. Yet, the above ground portion of the system is almost fully comprised of the light weight, yet strong steel. In turn, the base is made of the relatively heavy, stable concrete which cannot corrode.

The invention also relates to the ability of the system to be easily adapted, assembled, and installed. The invention advantageously overcomes the problems associated with installation such as reducing labor costs, material costs, and design costs. It also provides ways to insure installation is reliable such as providing for ways to plumb the base and/or pole segments to insure that they are generally vertical during and after installation.

Still further, the invention overcomes the severe problem in the art of not being able to easily custom design the system of pole structures for each installation and then easily ship, install and maintain those poles.

DETAILED DESCRIPTION OF THE PREFERRED EMBODIMENT

Figure 1:
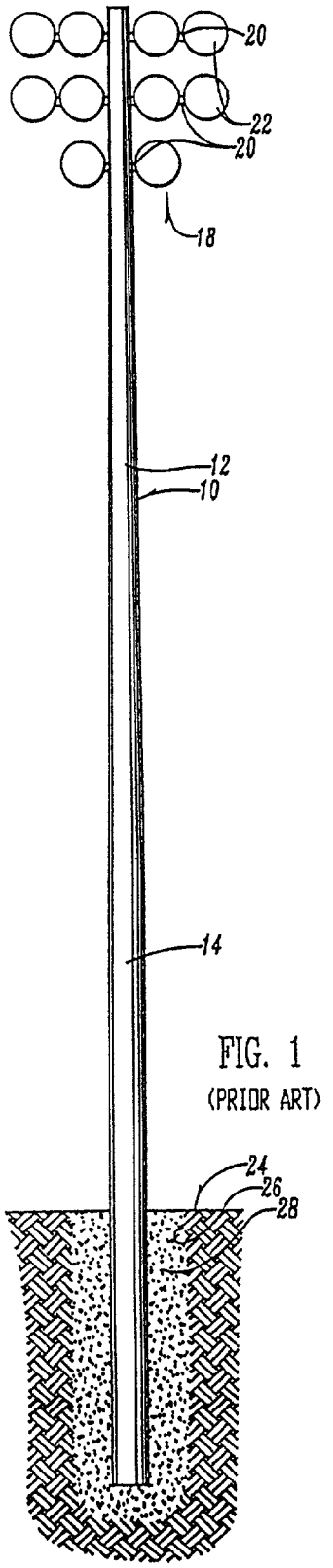
FIG. 1 (PRIOR ART)
FIG. 1 is a front partial sectional view of a prior art wooden pole set into the ground.

The detailed description of the preferred embodiments of the present invention will now be set forth. It is to be understood that this detailed description is intended to aid in an understanding of the invention by discussing specific forms the invention can take. It does not, nor is it intended to, specifically limit the invention in its broad form.

This detailed description will be made with specific reference to the drawings comprised of FIGS. 1 through 25. Reference numerals are used to indicate specific parts or locations in the drawings. The same reference numerals will be used for the same parts or locations throughout the drawings unless otherwise indicated.

The broad invention has generally been described in the Summary of the Invention. It is to be understood that in the following description of specific preferred embodiments, the structure elevated by the poles will be light fixtures or arrays of light fixtures, such as are commonly used for lighting sporting fields such as softball fields, tennis courts, and the like. An example of one type of such arrays and fixtures can be found at commonly owned U.S. Pat. No. 4,190,881 by Drost and Gordin issued Feb. 26, 1980. As will be further understood, the present invention and all its preferred embodiments achieves at least all of the stated objectives of the invention. It provides a pole system which can be predesigned for specific applications. As will be understood further, the preferred embodiments of the invention will show how the system of the invention can be predesigned for a particular application and location. Furthermore, the invention is basically universal in that it can accommodate almost all combinations of height, weight, location, ground condition, shipping requirements, and installation problems. It can also maintain the critically important alignment both vertically and rotationally.

The invention accomplishes all of its objectives economically and by providing a strong, reliable, long lasting pole and base.

To emphasize the advantages of the invention, the description will first again briefly review some of the problems and deficiencies of commonly utilized prior art poles. The advantages of the present invention will then be briefly discussed with particular reference to use as light poles, and then the specifics of the invention as applied to light poles will be set forth.

FIG. 1 shows a wooden light pole 10 having an upper section 12 and a lower section 14. An array of light fixtures 18 includes three cross arms 20, each carrying a plurality of light units 22 and is attached to upper section 12 of pole 10 by means known in the art (not shown).

Pole 10 is installed in ground or soil 24 in an excavation hole 26. As is commonly done in the art, the space around pole 10 in hole 26 is filled with a filler material to attempt to better anchor pole 10 in the soil 24. Examples of material 28 are soil, tamped rock, or poured concrete, such as is known in the art. Concrete has the advantage that it does not depend as heavily upon the skill of the contractor for a reliable foundation. Tamping rock properly in a deep hole is difficult and time-consuming.

The problems with wood poles have been previously discussed. Briefly, they are fairly heavy, are susceptible to rot and decay, and it is difficult to find tall and straight poles. Twisting and warping can also cause problems, such as misalignment of the structure held by the pole, for example, light fixtures. Perhaps more significantly, the installation of the lower section 14 into ground 24 requires an exact and well executed process to make sure the pole is vertical or plumb, and that it will stay that way. Transportation of long poles is also a problem.

As can be well appreciated by those of ordinary skill in the art, sometimes poles are simply inserted into hole 26, which is then backfilled with the removed soil. Soil simply does not have the density or properties to reliably hold the pole in aligned position either from axial, twisting (rotational), or lateral movement over time. By adding material 28, the effective area of the portion of pole 10 in ground 24 is increased, and the properties of the material are such as to improve stability.

This process still relies significantly on the type of installation job done by the installers. It can be seen that the wood is exposed at ground level to moisture as is previously described.

It is also to be understood that if crushed rock is used as material 28 when installing any type of pole, it is crucial that it be tamped accurately or the pole will lean. This requires the rental or use of pneumatic tamper machine and knowledge of how to accurately perform the tamping. This is a time-consuming task.

Figure 2:
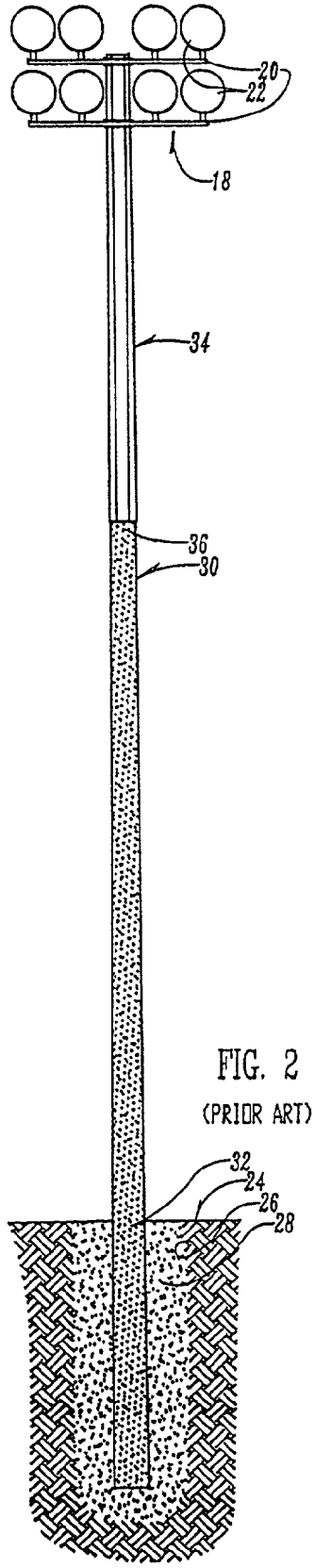
FIG. 2 (PRIOR ART)
FIG. 2 is a similar front elevational view of a prior art substantially concrete pole set into the ground.

FIG. 2 similarly shows concrete light pole 30 having a lower end 32 anchored in ground 24 surrounded by material 28 like the embodiment of FIG. 1. Additionally, in this prior art embodiment, a steel top section 34 is fitted over top end 36 of pole 30 and array 18 of lights is in turn connected to top section 34.

The problems with concrete poles have been previously discussed. Although corrosion around ground level is not a problem because of the use of concrete, the extreme weight of such a mass many times causes pole 30 to sink into the soil or otherwise tilt or laterally move. Similar problems in installation for concrete poles exist as with pole 10 of FIG. 1. Transportation of long poles because of length and weight is also a problem.

Figure 3:
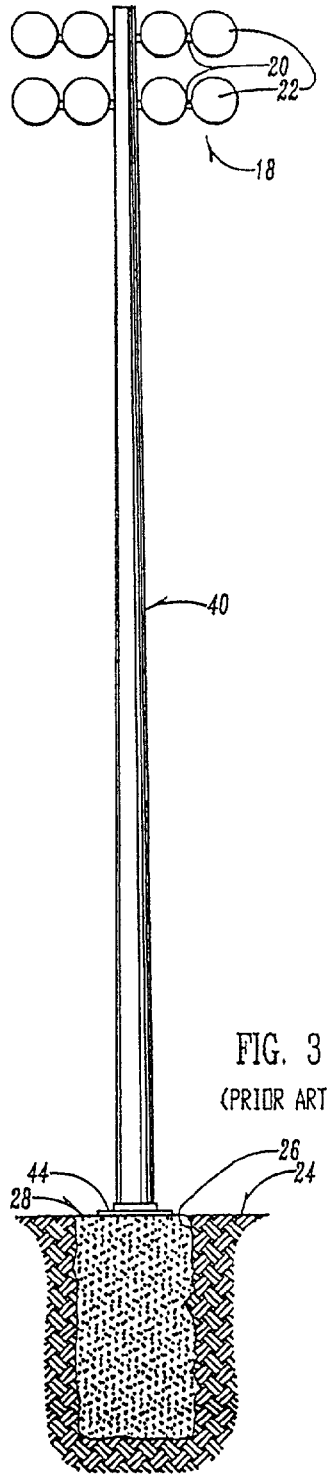
FIG. 3 (PRIOR ART)
FIG. 3 is a similar front elevational view of a steel pole with a poured concrete foundation in the ground as known in the prior art.

Therefore, FIG. 3 depicts the prior art light pole of preference, namely steel light pole 40 which is connected to bolts 46 (see FIG. 5), which are secured in material 28, which is generally concrete. Array 18 of lights is secured by means known within the art to the top of steel light pole 40, whereas the bottom of pole 40 has an annular flange 44 surrounding tubular pole 40 which is welded to pole 40 and secured by bolts to material 28. Material 28 is poured concrete with a re-bar design that must be installed on-site and is used to fill excavated hole 26 It can be seen, however, that flange 44 is within the high corrosion area near the ground.

Additionally, such as is known in the art, the joint created at flange 44 bears a high amount of stress for the entire combination. It therefore presents an unreliability factor in the sense of concentrating a significant amount of stress in one location. This is particularly true when referring to the potential corrosion problems created by the joint. It must be additionally understood that many times moisture accumulates within the interior of these hollow poles and corroded material and moisture can fall through the pole to the area around flange 44. This adds to the possible corrosion. Corrosion is virtually as big a problem inside-out as it is from the outside-in for these types of poles.

Even though the pole of FIG. 3 is the most expensive, for reasons previously described, it is also the most preferred because it is lightweight, strong, aesthically pleasing, and its installation is relatively easy when compared to a preferred ground concrete fill (FIG. 3) or properly tamped rock backfill, and when compared to installations such as is shown in FIGS. 1 and 2 which require a large crane to handle the higher weight of the wood or particularly the concrete poles. Additionally, if material 28 is cement, for optimum results, the crane must continue to hold the poles until the concrete is basically set. This requires time and money to rent the crane for that period, and hire the labor for that period, as opposed to pole 40 of FIG. 3 where the concrete fill 28 can be set (requires up to 28 days to set up) and then the pole 40 afterwise installed. It is to be understood that the setup time for concrete is generally in terms of hours. Concrete truck cannot wait hours at a time. Therefore, it requires generally a truck trip per pole which can be very expensive. Also, unless multiple cranes are available, only one pole can be installed over a period of hours.

Figure 4:
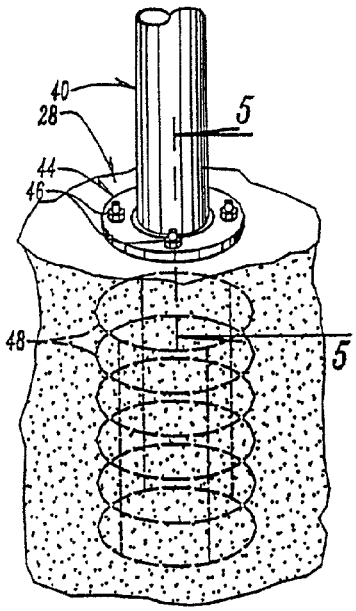
FIG. 4 (PRIOR ART)
FIG. 4 is a perspective view of the foundation and lower portion of the steel and concrete pole combination of prior art FIG. 3.
Figure 5:
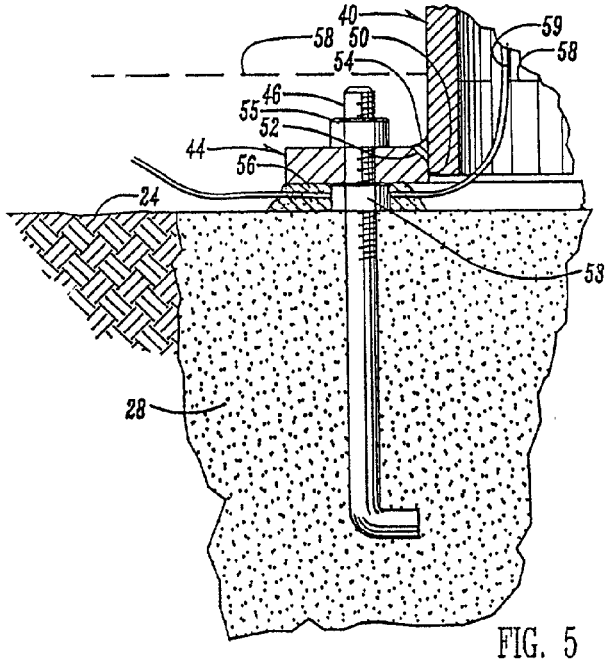
FIG. 5 (PRIOR ART)
FIG. 5 is a sectional view taken along line 5—5 of FIG. 4.

FIGS. 4 and 5 show in more detail the specifics of pole and poured foundation 28 and 42 of FIG. 3. In FIG. 4, it can be seen that flange 44 is attached to fill material 28 by the use of long bolts 46 which extend deep into the material 28 and are set there when the concrete is formed. Additionally, lines 48 represent generally the re-bar or reinforcing bars that need to be designed into material 28 for each specific application. Because bolts 46 extend deep into material 28, a significant amount of stress of the whole system must be borne by material 28 so that bolts 46 will not pull out. Thus, the special and specific designing of each foundation 28 for each application (pole height, weight, wind load, etc.) must be accurately predicted and implemented into the foundation 28 for it to be successful.

FIG. 5 depicts bolts 46 and also shows how flange 44 receives a portion of the bottom of the pole 40 in circular aperture 50 that is completely through flange 44. Many times an angled or beveled edge 52 is machined into flange 44 at the upper junction between material 28 and pole 40 to allow for weld 54. FIG. 5 shows how thicknesses of flange 44 and pole 40 vary, how it would be crucial for weld 54 to be done accurately, and how the various problems with corrosion and galvanization can occur as previously described. It is to be understood that many times, to get a strong enough junction weld 54 must be a "triple weld" which refers to multiple layers of welds around pole 40 in the groove formed by beveled edge 52. The expense for this is substantial as well as the reliance on the effectiveness of the welds. It complicates the galvanization because of significant heat and residue flux. It is to be understood that welds could also be placed inside aperture 50 at the bottom of pole 40.

FIG. 5 also shows that conventionally, nuts 53 are first threaded onto bolts 46. Base plate 44 is then inserted onto the bolts and rests on nuts 53. Nuts 55 then secured plate 44 to bolts 46. Grout 56 is used to attempt to seal between plate 44 and foundation 28. The stress on the joint can therefore be seen. Also, sometimes conduit or wiring 59 must be run through grout 56 into pole 40. As can be appreciated, water (represented by line 58) can accumulate or stand exactly around this joint, both outside and inside the pole, whether from rain, condensation, or other causes. The grout, manner junctions between parts, and openings presents a risky corrosion environment right at or near ground level.

Therefore, the preferred embodiments of the present invention illustrate how many of these problems in the prior art are overcome. The following will be a brief description of the elements for preferred embodiments of the present invention. Discussion of how the system of the invention allows for easy design, manufacturing, installation, and maintenance will follow that.

Figure 6:
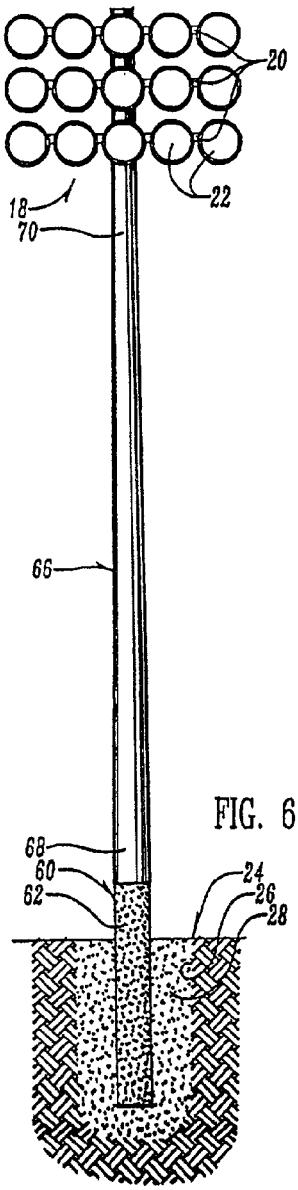
FIG. 6 is a front elevational view with a partial sectional view around the base of one embodiment of the invention.

FIG. 6 shows one preferred embodiment of the invention. A pre-cast, pre-stressed concrete base 60 has a lower section 62 which can be anchored in ground 24. It is generally preferred to anchor base 60 in material 28 which is poured concrete. An upper section 64 (see FIG. 8) of base 60 is tapered inwardly and upwardly. It is to be understood that the tapered upper Section 64 is above ground level of ground 24 and preferably generally two or so feet above ground 24. It should also be understood that upper section 64 does not need to be tapered as will be later discussed.

The invention allows a pole to be comprised of either one steel section, or several relatively short, lightweight, and convenient-to-assemble sections. With respect to a pole holding an array of lights for an athletic field, this allows:

1. Ease of separately establishing a pre-manufactured concrete base rigidly fixed in the earth;
2. Advantage of a lightweight but strong top section pre-assembled with a pre-aimed array of-fixtures which must accurately point to the field; and
3. Easy attachment of the pole to the base with universal orientation of lights to the field.

In the embodiment of FIG. 6, a pole section 66 is slip fitted onto tapered upper section 64 (see FIG. 8) of base 60. Pole section 66 itself is tapered along its entire length from its lower end 68 to its upper end 70 to which is attached light array 18. It is to be understood that the inside diameter of lower end 68 of pole section 66 equal to or is just slightly larger than upper section 64 of base 60 when it is slip fitted down onto upper section 64. However, because of the relative tapers, the farther pole section 66 is brought down upon upper section 64 of base 60, the tighter the two components become locked. Therefore, by utilizing sufficient force, the base 60 and pole section 66 can virtually become locked together without additional hardware.

This means that the outside diameter of lower section 62 of base 60 is greater than the inside diameter of part of pole section 66. It is again to be understood that the invention also contemplates use with bases and pole sections which are not tapered.

In FIG. 6, pole section 66 could be about 40 feet in length with a bottom inside diameter of around 9½ inches, and can utilize a 0.07 inch per foot taper uniform around the pole's circumference (as measured along a side of the pole section 66). Base 60 has a similar 0.07 inch per foot tapered top section 64 approximately 6 feet long with an overall length of close to 15 feet. The outside diameter of lower section 62 of base 60 is also around 9½ inches.

Figure 7:
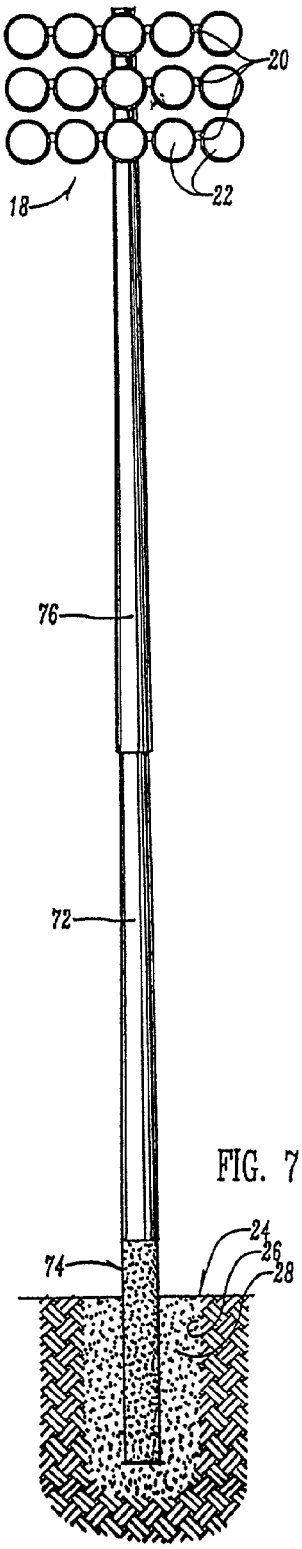
FIG. 7 is a similar view to FIG. 6 showing an alternative embodiment of the present invention.

FIG. 7 shows an alternative embodiment for the invention. Instead of just one pole section 66, a lower pole section 72 is slip fitted onto base 74 and an upper pole section 76 having the same taper from top to bottom as section 72 is slip fitted onto the top of lower pole section 72. It can be locked into position in the same manner as previously described. It can therefore be seen that a plurality of pole sections can be added to base 60 to achieve required height for a structure. It is to be understood that the width and length of base 60 or 74 is designed for overall height, weight, and load carrying ability for each pole structure. Generally, the width and height of base 74 would be greater than that for base 60 under fairly similar conditions because of the added height.

In FIG. 7, base 74 is around 20 feet long with a lower section diameter of around 13½ inches. Pole section 72 is 40 feet long, has a lower diameter of around 13½ inches and is slip fitted about 6 feet down on base 74 but not lower than about 2 feet above the around. 12 feet of base 74 extends below ground therefore. Pole section 76 is around 30 feet long, has a lower end diameter configured to allow it to slip fit approximately 2 feet over the top of pole section 74. Appropriate gauge steel is selected for height and load, and the strength of base 74 is computed for these parameters. Generally, most poles must be made to withstand 80 mph wind with 1.3 gust factor which includes consideration of fixtures attached at the top.

Figure 8:
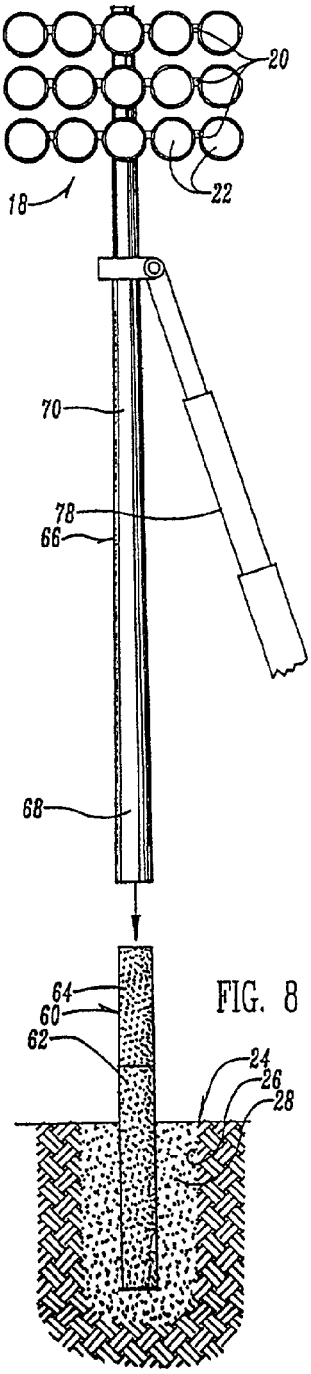
FIG. 8 is a view similar to FIG. 6 showing one method of installation of the metal pole section to the concrete base according to the present invention.

FIG. 8 depicts one method by which pole section 66 of FIG. 6 could be slip fitted onto base 60. A crane or extendable arm 78 grasping pole section 66 could maneuver it over base 60 and then slide or slip fit it down into position. It is to be understood that in the preferred embodiment, pole 66 is first gently slip fit onto base 60. Because generally light array 18 has been mounted, some rotational positioning of pole section 66 may be necessary, so that array 18 is facing in the correct direction. As one of the major advantages of the present invention, even after this preliminary installation, the pole section 66 can virtually be adjusted 360° around base 60.

Figure 9:
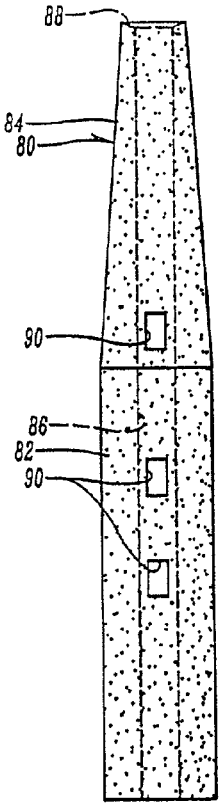
FIG. 9 is an enlarged front elevational view of one embodiment of the concrete base for the present invention.
Figure 10:
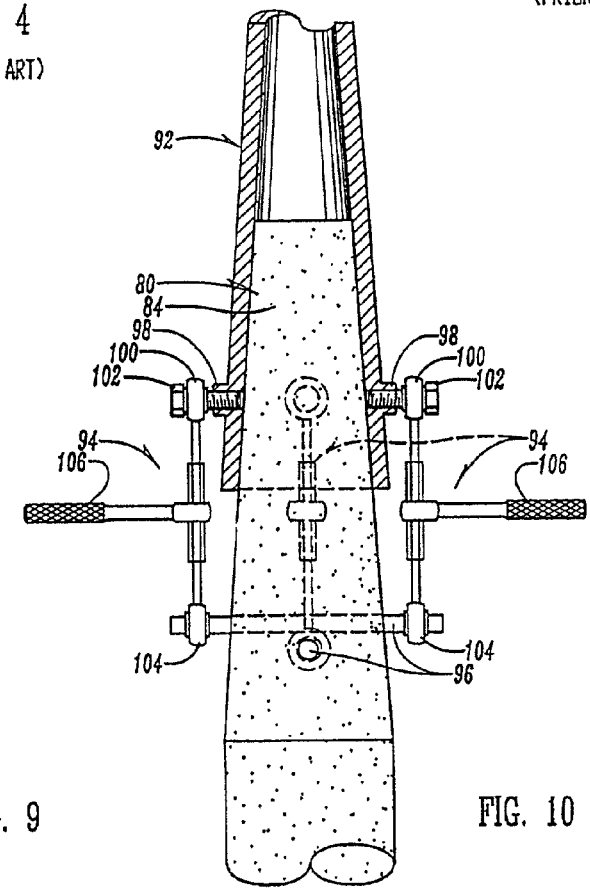
FIG. 10 is a partial still further enlarged view of an upper tapered section of the concrete base and the lower tapered portion of the steel pole section according to one embodiment of the present invention illustrating how these two elements are slip fitted together and ultimately locked together.

FIG. 9 shows in enlarged form a preferred embodiment of a base 80 according to the present invention. As can be seen, lower section 82 can be generally cylindrical in nature. Upper section 84 is basically frusto-conical and has a not very pronounced taper. Base 80 is hollowed out by bore 86 extending through it. Base 80 could be solid, however. It is particularly pointed out that at the top of upper section 84, a bevel 88 is introduced so that any moisture will run off bevel 88 down bore 86 away from the pole which will be slip fitted upon base 80. Additionally, openings 90 communicate with bore 86 to provide access for cables, wiring, and the like into the interior of base 80 and through the upper open end of base 80 into the interior of any pole section. FIG. 10 is a still further enlarged partial view of base 80 and shows a pole section 92 at least partially slip fitted onto upper section 84 of base 80. In order to pull pole section 92 further down tapered upper section 84 of base 80, and to more securely lock the pole and base together, one way to accomplish the same is to utilize ratcheting turnbuckles 94 to exert force to pull pole section 92 downwardly. A bar 96 can be inserted through a bore transversely through base 80. A nut 98 can be welded to one or more sides of pole section 92 and a bolt 100 can be threaded into nut 98. Ends 102 and 104 of turnbuckle 94 can be secured to bar 96 and bolt 100 respectively. By operation of handle 106, the turnbuckle 94 can cause downward movement of ends 102 and 104 to provide the pulling force and thus lock section 92 onto base 80.

It is to be understood that multiple ratcheting turnbuckles 94 (and nuts 98 and bars 104) could be utilized around the perimeter, or one could be connected at various positions. For example, this procedure could be used on opposite sides of pole section 92. It is to be further understood that the somewhat resilient nature of steel of pole 92 in the preferred embodiment allows some slight spreading which contributes to the resilient forces and frictional engagement of pole 92 to base 80. Therefore, no other hardware is needed for a secure junction.

Figure 11:
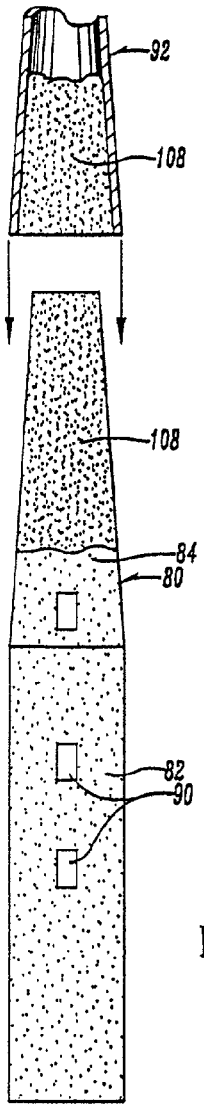
FIG. 11 is a front elevational view of a tapered concrete base and tapered lower part of the pole section according to the present invention, showing the use of a coating to assist in installation of the system.

FIG. 11, however, shows an alternative method for locking pole section 92 to base 80. Instead of requiring the use of force to pull the two elements together, a substance 108 could be coated over either the upper section 84 of base 80 or the interior of the bottom inside of pole section 92, or both. Substance 108 can be an adhesive which would first allow the initial slip fitting of pole section 92 to base 80 to provide abutment and then lock the two elements in place. The large surface area between the pole section and base when slip-fitted together allows for perhaps not quite as good adhesive to be used to accomplish its purpose compared with a joint of smaller abutting surface areas. It is to be understood that such a configuration reduces or eliminates significant gaps, pockets, or chambers at the joint. Additionally, the use of the substance 108 could completely fill any air gaps or spaces whatsoever and virtually eliminate places for water or air to work at corrosion. The ability of the semi-solid or initially liquid substance to be directed to fill up all spaces allows this advantage.

It is to be further understood that substance 108 could have other advantageous properties. For example, it could have lubricating properties to facilitate easier slip fitting and 360° rotation of pole section 92. It could also have sealant properties to further resist moisture and corrosion. As an alternative, substance 108 could have any one of the above mentioned properties and be advantageously utilized with the invention. It is preferred, however, that it have at least adhesive properties. In the preferred embodiment, an epoxy substance, such as is known in the art, could be used which would bond to both steel and concrete. Alternatively, silastic (silicone), or urethane could be utilized. In general, substance 108 is applied in between a 5 to 30 mil thick coating, and generally more along the lines of a 10 mil thick coating.

This eliminates the need for jacking the two elements together, such as was explained with respect to FIG. 10, which in many applications requires up to 2000 lbs. of pressure on each side and up to 6 to 8 inches of further movement between the elements to get a secure locking fit.

It is also to be understood that to further prevent corrosion possibilities, gaskets or sealants could be used to completely seal or fill up any spaces whatsoever in base 80 or between the pole and base.

It can therefore be seen that the present invention utilizes a tapered end of the base and the tapered pole sections to allow easy and economical creation of a pole structure. To aid in an understanding of how the invention in a complicated and arduous manner provides such an advantageous combination, a short discussion of many of the factors involved in designing this combination will be set forth.

With regard to pole section 92, the following types (by no means an exhaustive list) of elements have to be considered:

1. Amount of taper.
2. Shape and diameter of pole.
3. Number of sections.
4. Number of connections.
5. Weight to strength ratio.
6. Wind load.
7. Type of steel/gauge of steel/wall thickness.
8. Stress through pole.
9. Corrosion resistance.
10. Galvanization inside and out.
11. Rotational alignment ability.
12. Transportability (length, diameter, weight).
13. Electrical or other interior connections or pieces.
14. Length of slip fit.
15. Crane or other lifting means size and availability.
16. Cost of materials.
17. Industry standards.
18. Type of structure to be suspended.
19. Installation location variables.

It is to be understood that a similar plurality of factors must also be analyzed for the base 80 (further including properties unique to concrete and its use as a support base in the ground) and the composite combination of base 80 and pole 92, as can be appreciated by those skilled in the art.

In the preferred embodiment, the taper of pole section 92 is a 0.14 inch reduction in diameter for every foot upwardly (or in other words, a small angular degree of fraction of degree inward taper). A possible range of tapers would be from 0.12 through 0.16 plus or minus 0.020 inch taper per foot of length. This is the equivalent of the previously mentioned 0.07 inch per foot taper.

The taper allows the stress experienced by the pole section to be distributed over 100% of the pole, and not necessarily concentrated in any certain areas.

While the shape of the preferred embodiment of the pole is circular in cross section, other shapes are possible where poles need not be rotated for precision alignment of fixtures after the base is set (see FIGS. 24A–24D). Base 80 has a similar or exactly identical taper to pole 92. In the preferred embodiment, the base is hollow to reduce weight and allow wiring, etc. to be brought in from the ground into the pole, and is made even lighter by utilizing pre-stressed concrete (more strength per pound). Wound wire is used instead of re-bar. The wound wire has a tensile strength of between 250 and 275 thousand psi (pounds per square inch). The concrete base 80 is then centrifugally cast to provide a high density outside layer which is extremely strong and is more resistant to moisture penetration.

The need for the tapered joint between base 80 and pole 92 to be precise is essential. The base 90 is therefore cast in a steel die and spun for 20 minutes. It is then cured in steam for one day. Afterwards, it sits for a substantial period until it reaches its full strength.

By using this high strength concrete, the weight is reduced but the strength is retained.

It is to be understood that base 80 can be made longer for different soil conditions and can be made longer and wider for different heights and stress conditions for poles. Generally in the preferred embodiment, upper section 84 of base 80 is somewhere around 7 to 8 feet in length. Because of the long overlap for the slip fit joint (generally the 7 to 8 feet for 7 to 8 feet upper section 84), this comprises a relatively low stress joint because it involves substantial surface area contact and overlap length between members. There are no welds, bolts, or any other hardware in this joint area (which can weaken the joint or present focused stress points). Additionally, it is above the primary corrosion zone by remaining two or more feet above the ground. Additionally, the thickness of pole section 92 is the same throughout its length and therefore it is easier to reliably galvanize the steel.

It is therefore crucial to understand that when designing and manufacturing the components for the invention, a variety of different design considerations are taken into effect. However, the advantage of the present invention is that they can be analyzed and contemplated during design and then pre-manufactured to allow an entire unit (pole section(s) and base) to be shipped together (along with fixtures and arrays). Quality control over all of the elements can be more easily accomplished.

The problems with shipping with prior art devices have been previously discussed. As can be seen in these preferred embodiments, the lower weight of the pre-stressed concrete base 80, the lower weight of the hollow pole section 90 and any additional sections, as well as the ability to section the pole (if needed) allows for better flexibility and more economical shipping.

The additional advantages of the invention can be seen with respect to installation on site.

Figures 22, 23, 24A, 24B, 24C, 24D, 25:
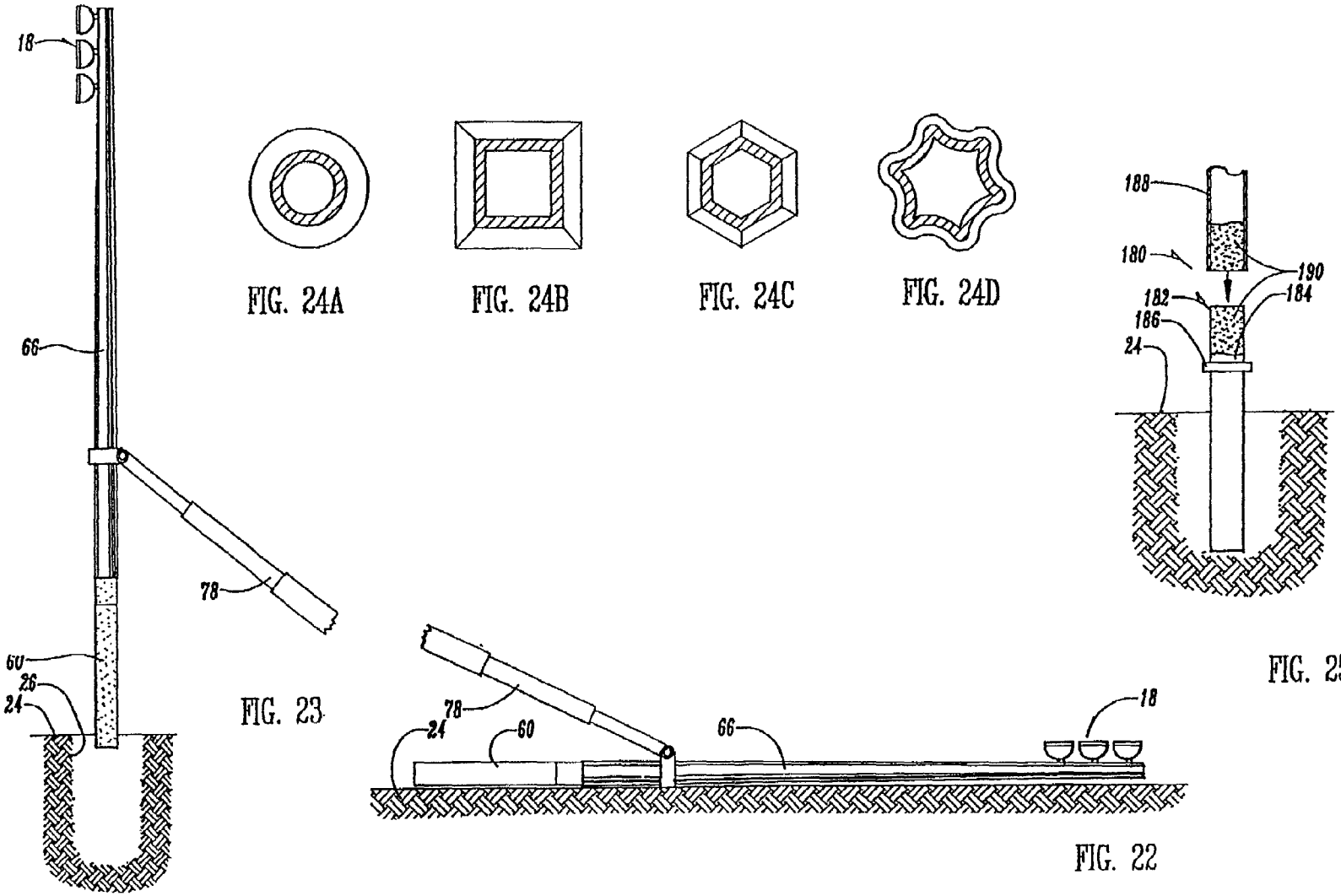
FIGS. 22 and 23 are side views depicting a method for pre-assembling and installing a pole system according to the present invention.
FIGS. 24A, 24B, 24C, and 24D are cross sectional view of alternative pole structures that can be utilized according to the present invention.
FIG. 25 is a depiction of an alternative embodiment of the present invention where the base member and the pole section dc not have matching tapered portions, but slip fit together until abutting a stop member.

It is to be understood that one way to assemble and install a pole system according to the present invention would be to preassemble base 80 and any pole sections 92 horizontally on the ground or otherwise, and then utilize a crane or similar device to pull the combination upright and insert it into the excavated hole. Then dirt, rock, or-concrete could be poured around base 80 to set the combination in place. Such a process is schematically depicted at FIGS. 22 and 23. It is to be understood that various disadvantages of this method have been previously discussed. One advantage of the present invention, however, is that a majority of the weight of the combination is in base 80. Therefore, the crane or other device would be able to grip the assembly at a lower point (i.e., towards the center of gravity of the assembly). From a practical viewpoint, this allows use of a smaller crane or other machine which significantly reduces cost if the crane were rented or otherwise leased.

Secondly, flexibility of the invention can be seen in that the base 80 could first be anchored in the ground and made plumb, and then the pole sections can be slip fitted into place in any manner desired. This would be done, preferably, by setting the base 80 in concrete to avoid the unreliable backfill of rock or dirt. Generally, the pole sections would be pre-assembled and then the entire structure would be slip fitted to base 80. This produces a reliable, rigid installation and alignment.

Figure 12:
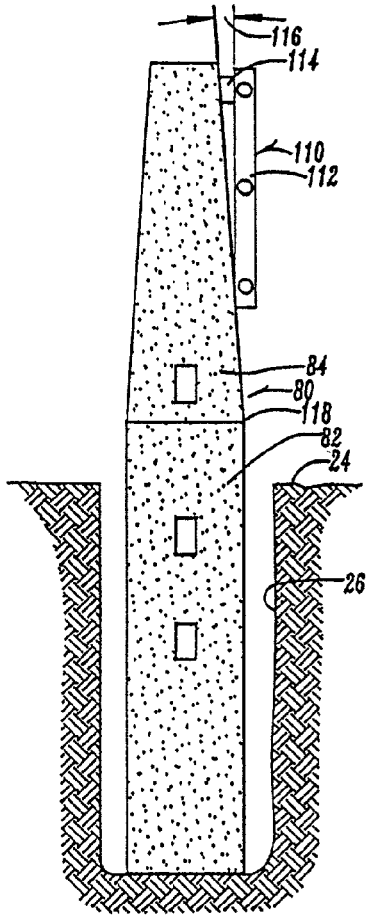
FIG. 12 is a front elevational view of a base member according to the present invention positioned in an excavated hole for anchoring in the ground, further showing a leveling or plumb means used to insure the base is plumb or vertical during installation.

A number of advantageous methods have been developed to facilitate this type of installation. First, as shown in FIG. 12, base 80 can be, by means known within the art, set within excavated hole 26 so that it rests on the bottom of the hole. A level means 110 comprised of an elongated linear level 112 (in this case four feet long) with a transversely extending foot 114 can be utilized in the position shown in FIG. 12 to level or plumb base 80. Foot 114 would be of a transverse length (approximately ¼" for a 4 foot long level and a 0.14 inch taper per diameter for every foot) so that knowing the taper of upper section 84 of base 80, when placed against the taper in the position shown in FIG. 12, level 112 will read that base 80 is vertical along its longitudinal axis only when level 112 is vertical. In other words, the tangent of the angle 116 formed between level 112 and taperd side of upper section 84 would equal the length of foot 114 divided by the length of level 112. Level means 110 can be moved around the perimeter of upper section 84 to insure it is plumb in all directions. This leveling process could take place as concrete or other fill is put into hole 26 and such sets up. Then the verticality of any pole sections 92 slip fitted onto base 80 is assured. It is also to be understood that level 112 could be used with other installation methods.

Figure 13:
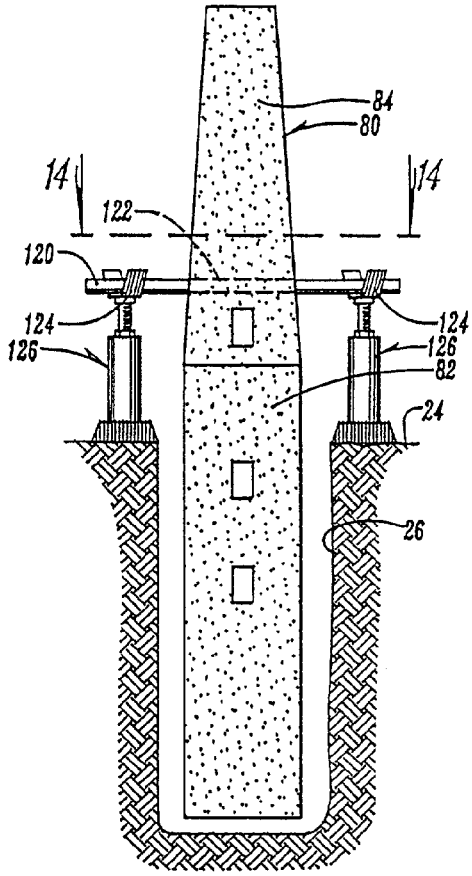
FIG. 13 is a front elevational view similar to FIG. 12 showing an alternative combination for leveling or plumbing the base member.

FIG. 13 shows an alternative method to level or plumb base 80 (especially when base 80 is not, or cannot be set on the bottom of hole 26). It is to be understood that a slurry is preferred to be used to keep base 80 plumb during pouring of the concrete. A bar 120 inserted through a lateral bore 122 which is generally perpendicular to the longitudinal axis through base 80 could be utilized to sit into V-brackets 124 of screw jacks 126 on opposite sides of base 80. In a pendulum like manner, base 80 could swing around bar 120 (the bottom of the base would not touch the bottom of excavated hole 26) to find its plumb position in that plane (a vertical plane through the longitudinal axis of base 80 and extending generally perpendicular to a vertical plane through bar 120). This allows for setting base 80 in holes deeper than base 80 or holes with a soft bottom which would not support base 80. Screw jacks 126 could then be adjusted and utilized with a conventional level on bar 120 or with respect to base 80 to insure that base 80 is level in the plane through the axis of bar 120 parallel to the page at FIG. 13.

Alternatively, one side of bar 120 could be blocked to a certain height and then one jack 126 could be used to level the other side. Additionally, a re-bar cage could be added to base 80 and extend to the bottom of hole 26, or more concrete could be added to fill up hole 26 under base 80.

Figure 15:
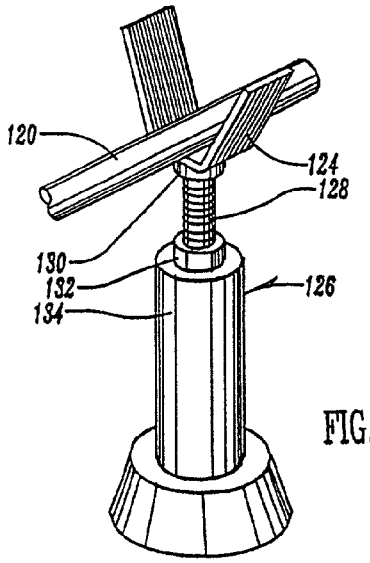
FIG. 15 is a perspective view of a leveling jack depicted in FIGS. 13 and 14.

FIG. 15 shows screw jack 126 in more detail. V-brackets 124 are rotatably mounted to screw rod 128. A nut 130 is rigidly secured to bracket 124 and screw rod 128 which is threadably mounted in nut 132 rigidly secured to base 134. By turning nut 132, screw rod 128 rotates and moves up and down in base 134.

Figure 16:
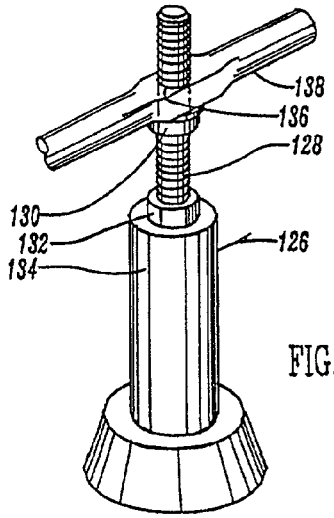
FIG. 16 is a perspective view of an alternative embodiment for a leveling jack.

FIG. 16 shows an alternative jack means that could be used in the embodiment of FIG. 13. Bar 120 could have an aperture 136 extending therethrough. Instead of V-brackets 124, screw rod 128 could simply extend through aperture 136. This time, by turning nut 130, bar 120 would be raised or lowered.

Figure 14:
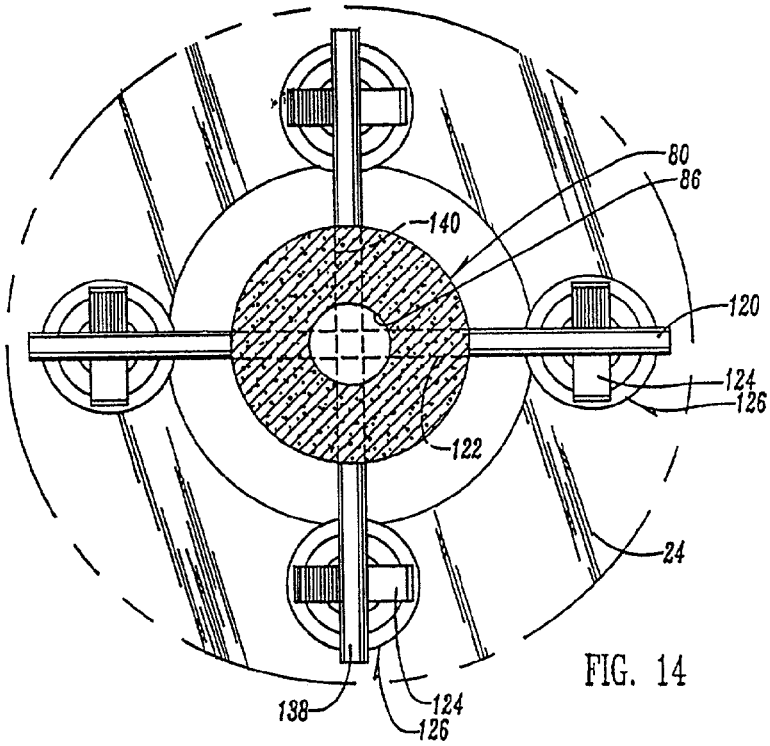
FIG. 14 is a sectional view taken along line 14—14 of FIG. 13, but including an additional cross bar through the base member and two additional leveling jacks from that illustrated in FIG. 13.

FIG. 14 shows an alternative embodiment to FIG. 13. To prevent base 80 from moving in any direction in excavated hole 26, an additional bar 138 could be inserted through an appropriate transverse bore 140 (close to but spaced from bore 122) through base 80 but in a perpendicular direction to bar 120. As shown in FIG. 14, additional screw jacks 126 would hold bar 138. All screw jacks 126 could be adjusted to level or plumb base 80. By utilizing the two bars, however, base 80 would be locked into position. Therefore, when pouring concrete or other material into hole 26, could not be easily moved out of alignment base 80.

Figure 17:
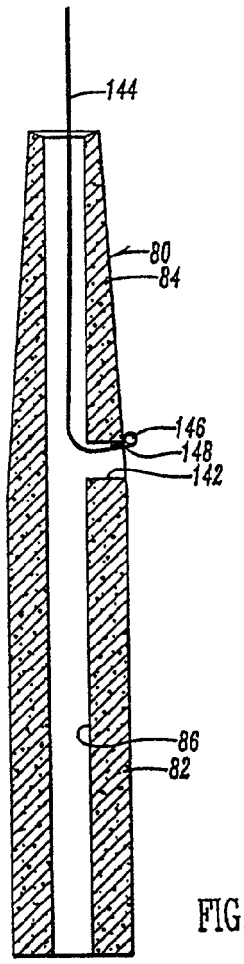
FIG. 17 is a sectional elevational view of a base member according to the present invention illustrating a means for lifting and positioning the base member within an excavated hole in a generally plumb position.
Figure 18:
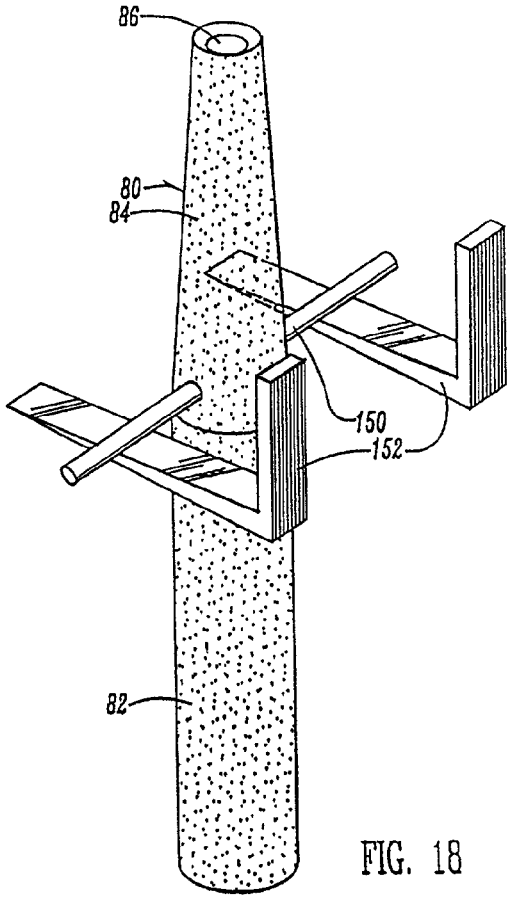
FIG. 18 is a partial perspective view of the base member according to the present invention showing means for a forklift to lift and position a base means in an excavated hole in a basically plumb position.

The FIGS. 17 and 18 show two further methods for installing base 80 into hole 26 in a plumb manner. In FIG. 17, an aperture 142 from the exterior of base 80 into bore 86 would allow a strap 144 connected to a crane or other machine to be inserted and threaded out aperture 142. A locking pin 146 could be slipped through loop 148 in the end of strap 144 to hold strap 144 in the position shown in FIG. 17. By virtue of suspending base 80 in the manner shown in FIG. 17, it would basically find its plumb position when lowered into hole 26.

In FIG. 18, a bar 150 is inserted transversely through base 80. This would allow a forklift 152 to raise base 80 and again it would act somewhat like a pendulum, at least in one plane to find its basically plumb position. The forklift can be maneuvered to keep base 80 plumb during backfill with concrete. Once the concrete is poured to top of hole 26, the forklift can be removed as concrete will support the weight of base 80 and keep it level.

Figure 19:
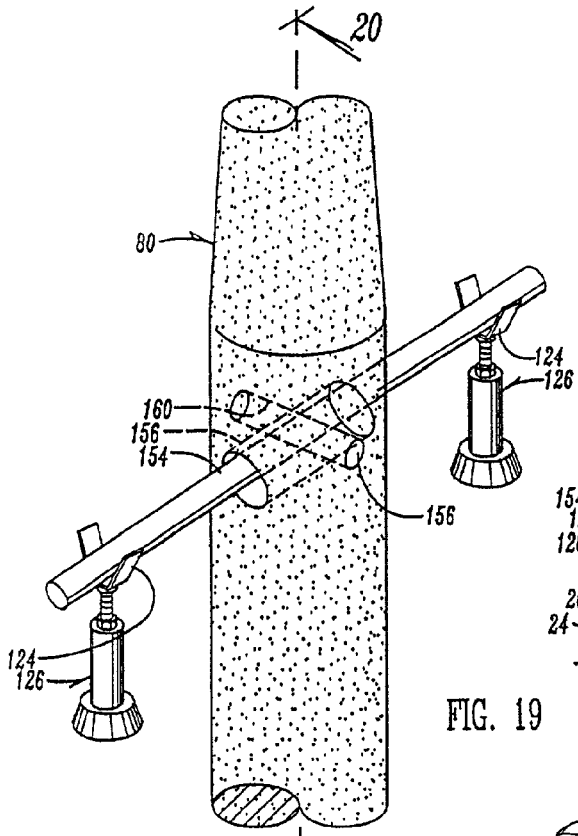
FIG. 19 is a partial perspective view of a still further embodiment for leveling and plumbing a base member in an excavated hole.
Figure 20:
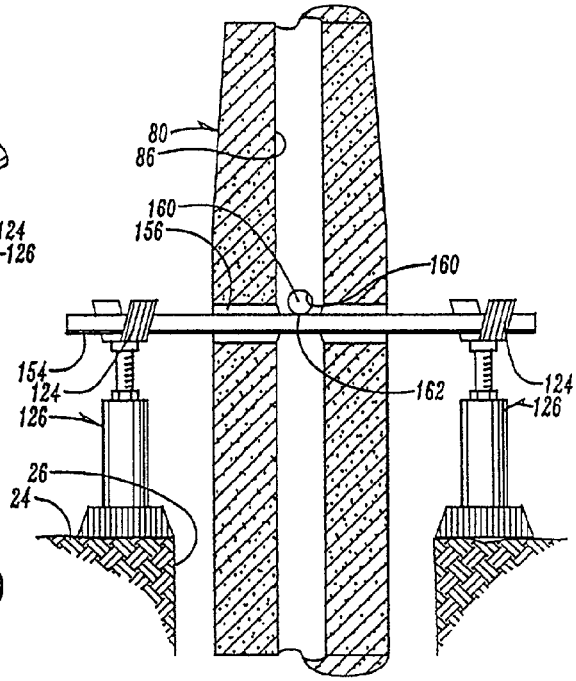
FIG. 20 is sectional view taken along line 20—20 of FIG. 19.
Figure 21:
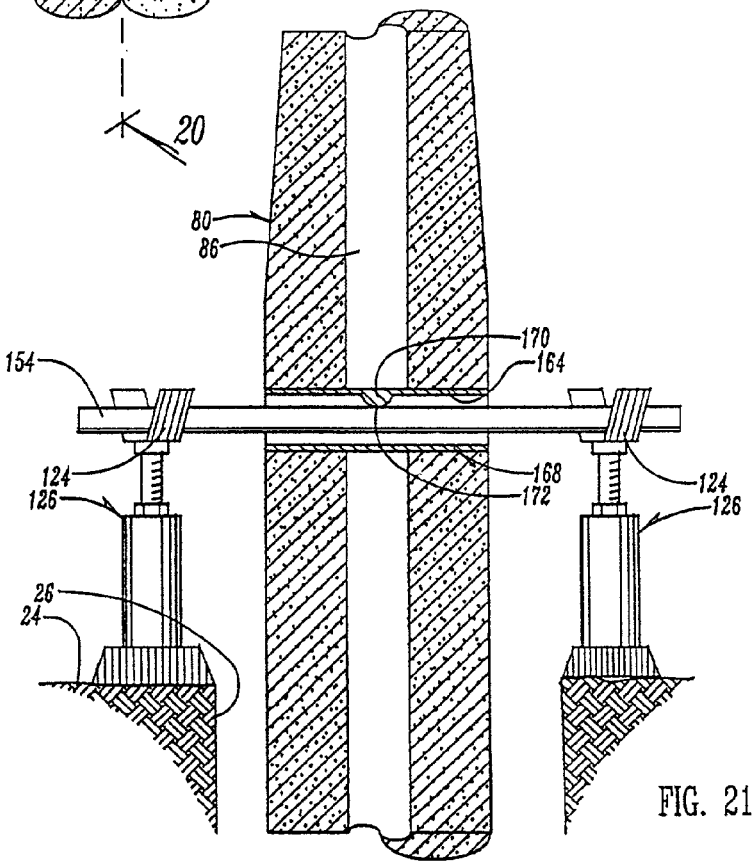
FIG. 21 is a still further alternative embodiment for a leveling or plumb means for the present invention.

FIGS. 19–21 show two additional, more intricate methods for plumbing base 80 in hole 26. In FIG. 19, a long bar 154 is inserted through an oversized bore 156 so that there is some play if base 80 were tilted in a vertical plane through bar 154. A short bar 158 is inserted in a bore 160 perpendicular to bore 156 but partially intersecting bore 156. As can be seen in FIG. 20, bar 158 would rest upon bar 154. Essentially, the abutment point 162 between bars 158 and 154 would be a small intersection of two rounded surfaces. Thus, base 80 would be able to tilt by the forces of gravity in virtually any direction. Abutment point 162 acts somewhat like a knife-edge balance point and allows base 80 to automatically plumb itself to the extent it is free to tilt in the setup. Screw jacks 126 can be utilized to roughly plumb base 80. A fluid slurry mix of concrete can be poured to allow base 80 to remain plumb.

FIG. 21 shows a modification of this self plumbing setup. To avoid having two transverse bores through base 80, FIG. 21 utilizes a large bore 164 in which a sleeve 168 is positioned. A rounded raised member extends from the interior center of the sleeve 168. Bar 154 and jacks 126 can then be configured as shown so that bar 154 extends through sleeve 168 the abutment point 172 between member 170 and bar 154 again acts as a knife-edge balance point to allow base 80 to plumb itself.

After installation by any of the above methods, the invention in its assembled form presents a pole having accurate and reliable anchoring in the ground, has sufficient strength in both the base and the pole sections, and is resistant to corrosion in the base and in the pole sections. It provides the preferred steel upwardly extending pole without the disadvantages of conventional steel poles. The invention therefore provides a long lasting durable pole, which impacts on the cost of such poles over their life spans.

It will therefore be appreciated that the present invention can take many forms and embodiments. The true essence and spirit of this invention are defined in the appended claims, and it is not intended that the embodiment of the invention presented herein should limit the scope thereof.

A primary example of an alternative embodiment according to the invention can be seen at FIG. 25. Embodiment 180 consists of a base 182 and pole section 188 similar to those previously described. However, base 182 has a straight (not tapered) top section 184. A stop member 186 extends laterally from base 182. Pole section 188 is also a straight-sided (not tapered) tube pole. It can be slip fitted onto top portion 184 of base 182 until it abuts stop 186. Epoxy 190 can be coated on both the exterior of base 182 and interior of pole 188 to assist in bonding the two. Sealant can also be used. It can be seen that pole 188 is again held above ground. This embodiment is particularly useful for square or multi-sided poles, that do not require or are not desired to be tapered.

It is also to be understood that the pole sections are preferred to be made of steel but other materials are possible, for example, aluminum.

As can be seen by referring to the prior art design in FIG. 5, the presently claimed invention completely eliminates all the problems associated with potential corrosion, stress, and even vandalism of the nuts, bolts, joint, and overall structure of that prior art embodiment, even though in the prior art design of FIG. 5, concrete is utilized in the ground, the metal is attempted to be galvanized, and grout or other sealant is attempted to be placed around the base/pole joint.

What is claimed is:

1. A pole and base system for holding an array of pre-aimed, high intensity light fixtures in an elevated position comprising:

a base comprising a single, elongated piece, a length of greater than about 8 feet and structural characteristics to support a pole and array of light fixtures thirty feet or higher above ground, and including a lower section comprising a majority of the length of the base adapted for insertion into the ground and an upper section adapted to extend above the ground when the base is inserted in the ground and having a taper decreasing about 0.12 to 0.16 inch per foot from at or near a bottom of the upper section to at or near a top of the upper section;

a pole comprising a length of around 30 feet or greater, a relatively thin wall, and at least one structural characteristic different from the base, an upper end, a lower open end, and an interior bore extending axially and inwardly from the lower open end, the interior bore having an inside diameter and taper generally matching the outside diameter of the upper section of the base and said pole being mateably slip-fitted over at least a portion of the upper section of the base, the length of the pole being substantially longer than the length of the base;

one or more cross arms attached at or near the upper end;

an array of pre-aimed light fixtures mounted to said one or more cross arms;

one or more connection members connecting the said one or more cross arms to the pole; and the upper section of the base positioning the lower open end of the pole, when slip-fitted onto the base, at least one foot above the ground but substantially nearer the ground than to the upper end of the pole when the pole is installed in operative position on the base and the lower section of the base is in operative position in the ground.

2. The pole and base system of claim 1 wherein the base is made from concrete.

3. The pole and base system of claim 2 wherein the base is made from hollowed concrete.

4. The pole and base system of claim 1 wherein the base includes a cylindrically shaped lower portion.

5. The pole and base system of claim 1 wherein the base includes a frusto-conically shaped upper section.

6. The pole and base system of claim 1 wherein the upper section of the base is decreasingly tapered at 0.14 inches across the diameter of the base per foot in height from at or near a bottom of the upper section to at or near a top of the upper section.

7. The pole and base system of claim 1 wherein the upper section of the base is a plurality of feet above ground.

8. The pole and base system of claim 1 wherein width and length of the base is related to required strength, height, and weight of the pole and structure attached to the pole.

9. The pole and base system of claim 1 wherein the pole is made from metal.

10. The pole and base system of claim 1 wherein the pole is hollow.

11. The pole and base system of claim 1 wherein the pole is tapered along its entire length.

12. The pole and base system of claim 11 wherein the pole has an elongated frusto-conical shape.

13. The pole and base system of claim 11 wherein the taper is approximately 0.14 inches in diameter per foot of length.

14. The pole and base system of claim 1 wherein the interior bore is slightly larger than the outside diameter of the upper section of the base.

15. The pole and base system of claim 1 wherein the slip fit between the base and pole locks the pole in place by resilient and frictional locking.

16. The pole and base system of claim 1 wherein the pole comprises a plurality of pole sections, a lowermost pole section being slip fittable over the upper section of the base, additional pole sections slip fittable, in succession, sequentially on a preceding pole section.

17. The pole and base system of claim 1 wherein the pole includes a mounting upon which can be connected the array to be elevated.

18. The pole and base system of claim 1 further comprising openings in the base and pole to allow access to the interior of the base and pole.

19. A method of rigidly suspending an array of pre-aimed, high intensity light fixtures in an elevated position comprising the steps of:

providing a base comprising a single, elongated piece of a length of greater than about 8 feet and structural characteristics to support a pole and array of light fixtures thirty feet or higher above ground, the base including a lower section comprising a majority of the length of the base which is adapted to be mounted in the ground and an upper section having a taper decreasing about 0.12 to 0.16 inch per foot from at or near a bottom of the upper section to at or near a top of the upper section;

positioning the upper section of the base above the ground when the base is mounted in the ground;

providing a relatively thin walled pole comprising a length of around 30 feet or greater and a structural characteristic different from the base, the pole including a bore mateably slip fittable over the upper section of the base, the length of the pole being substantially longer than the length of the base;

attaching to the pole an array of pre-aimed light fixtures mounted on one or more cross arms;

slip fitting the pole to the base so that the lower portion of the pole is at least one foot above but nearer the ground than the top of the pole when the pole is installed in operative position on the base.

20. The method of claim 19 further comprising positioning a stop on one of the base and pole for determining the distance upon which the pole slip fits over the base.

21. The method of claim 19 wherein the base is made of reinforced concrete.

22. The method of claim 19 wherein the pole is made of tubular metal.

23. The method of claim 19 comprising the step of matching the diameters and lengths of the base and pole according to pre-determined, required strength, height, and weight of the pole and the array.

24. The method of claim 19 wherein the pole comprises one or more pole sections each having a bore in a bottom portion so that each pole section can be sequentially slip fit to a preceding pole section.

25. The method of claim 19 wherein the pole comprises a first and a further pole section comprising the further step of slip fitting the first pole section to the base, slip fitting a further pole section to a preceding pole section to preassemble one or more pole sections and the base:

grasping the preassembled combination at approximately at or above the center of gravity;

moving the base into a previously excavated hole in the ground;

bringing the preassembled combination to a generally upright position;

adjusting the preassembled combination to plumb the preassembled combination; and filling the excavated hole to secure the preassembled combination in the plumb position.

26. The method of claim 19 further comprising the steps of:

moving the base to a pre-excavated hole in the ground; adjusting the base so that it is generally plumb; filling the remaining areas of the excavated hole with material to secure the base in the hole; and slip fitting said pole to the base.

27. The method of claim 26 wherein the base is moved to the excavated hole by fixing a carrying strap through a bore in the center of the base and by a crane lifting the base and placing it into the excavated hole.

28. The method of claim 26 wherein the step of moving the base into the excavated hole comprises:

forming a bore laterally through the base generally perpendicular to the longitudinal axis of the base;

slidably inserting an elongated bar through the bore, the bar having opposite ends which extend outwardly on each side of the base;

grasping each end of the bar with a lifting and motive device; and moving the base over and into the excavated hole.

29. The method of claim 28 wherein the bar allows the base to swing freely in a first plane so that the gravitational pull on the base plumbs the base in that plane.

30. The method of claim 29 further comprising first and second vertical jacks which can be placed on the ground and an upper end associated with the bar to raise and lower one side of the bar to level or plumb the base.

31. The method of claim 30 wherein each jack comprises an upper end having a v shape to receive the bar.

32. The method of claim 30 wherein each jack includes a vertically extending elongated member which slidably passes through a vertical bore in the bar.

33. The method of claim 29 further comprising a second bar extending through a bore laterally through and generally perpendicular to the longitudinal axis of the base, second bar being adaptable to receive a jack at opposite ends to fix the base in a plumb position.

34. The method of claim 29 further comprising a second bar extending through a bore generally perpendicular to the longitudinal axis of and laterally through the base, and generally perpendicular to the first bore, the first and second bores having an intersection location whereby the diameter of the first and second bores overlap at least in part so that the second bar abuts against the first bar to provide a balance point for the base, the balance point containing all the weight of the base at generally a small abutment of curved surfaces of the first and second bars to provide a self plumbing device.

35. The method of claim 29 further comprising a sleeve having an inside diameter greater than the outside diameter of the first bar and surrounding the first bar, the sleeve including generally at its mid-section generally coincident with the longitudinal axis of the base one or more balance nodes extending inwardly towards the longitudinal axis of the sleeve and onto which the first bar would abut, the balance nodes providing generally most of the gravitational pull for the base at that general location to provide self plumbing for the base.

36. The method of claim 26 wherein the base is plumbed by utilizing a level.

37. The method of claim 36 wherein the level comprises an elongated level having first and second ends, one of said first and second ends having attached to it an extensive member, the extension member having a transfer link from the level selected so that the angle formed between a line from the other of said ends of the level to the outer extended end of the extension member, in comparison with the edge of the level would be equal to the angle formed by a taper in the upper section of the base.

38. The method of claim 19 further comprising the steps of:

moving the base to a pre-excavated hole in the ground;

adjusting the base so that it is generally plumb;

filling the remaining areas of the excavated hole with material to secure the base in the hole; and slip fitting the pole to the base.

* * * * *

UNITED STATES PATENT AND TRADEMARK OFFICE

CERTIFICATE OF CORRECTION

PATENT NO. : 7,171,793 B2
APPLICATION NO. : 09/964301
DATED : February 6, 2007
INVENTOR(S) : Myron K. Gordin et al.

It is certified that error appears in the above-identified patent and that said Letters Patent is hereby corrected as shown below:

Col. 17, Claim 1, line 26:
After "at least a" insert --substantial--

Col. 17, Claim 1, line 30:
After "end" insert --of said pole--

Signed and Sealed this

Third Day of April, 2007

JON W. DUDAS
*Director of the United States Patent and Trademark Office*